US006811016B2

(12) United States Patent
Blair

(10) Patent No.: US 6,811,016 B2
(45) Date of Patent: Nov. 2, 2004

(54) VIGNETTE INSPECTION SYSTEM

(75) Inventor: Ronald Bruce Blair, Flower Mound, TX (US)

(73) Assignee: De La Rue Cash Systems Inc. FKA Currency Systems International, Inc., Irving, TX (US)

( * ) Notice: Subject to any disclaimer, the term of this patent is extended or adjusted under 35 U.S.C. 154(b) by 112 days.

(21) Appl. No.: 10/289,083

(22) Filed: Nov. 6, 2002

(65) Prior Publication Data

US 2004/0084277 A1 May 6, 2004

(51) Int. Cl.[7] ..... G07F 7/04
(52) U.S. Cl. ..... 194/206; 209/534
(58) Field of Search ..... 194/206, 207, 194/205; 209/534; 250/548, 559.01, 559.04, 559.08, 559.11, 559.39, 559.44, 556

(56) References Cited

U.S. PATENT DOCUMENTS

| | | | | | |
|---|---|---|---|---|---|
| 2,950,799 | A | | 8/1960 | Timms | |
| 3,222,057 | A | | 12/1965 | Couri | |
| 3,759,382 | A | | 9/1973 | Walkley et al. | |
| 3,782,543 | A | * | 1/1974 | Martelli et al. | 209/555 |
| 3,916,194 | A | | 10/1975 | Novak et al. | |
| 3,932,272 | A | | 1/1976 | Carnes, Jr. et al. | |
| 4,187,463 | A | | 2/1980 | Kivenson | |
| 4,255,057 | A | | 3/1981 | Williams | |
| 4,463,250 | A | | 7/1984 | McNeight et al. | |
| 4,463,607 | A | | 8/1984 | Hilton | |
| 4,519,249 | A | | 5/1985 | Hunt | |
| 4,587,434 | A | | 5/1986 | Roes et al. | |
| 4,592,090 | A | | 5/1986 | Curl et al. | |
| 4,611,345 | A | | 9/1986 | Ohnishi et al. | |
| 5,295,196 | A | | 3/1994 | Raterman et al. | |
| 5,417,316 | A | | 5/1995 | Harbaugh | |
| 5,476,169 | A | * | 12/1995 | Takarada et al. | 194/207 |
| 5,545,885 | A | | 8/1996 | Jagielinski | |
| 5,875,259 | A | | 2/1999 | Mennie et al. | |
| 5,903,339 | A | * | 5/1999 | Levasseur | 356/71 |
| 5,923,413 | A | | 7/1999 | Laskowski | |
| 5,955,741 | A | * | 9/1999 | Kayani | 250/559.11 |
| 6,028,951 | A | | 2/2000 | Raterman et al. | |
| 6,040,584 | A | | 3/2000 | Liu et al. | |
| 6,073,744 | A | | 6/2000 | Raterman et al. | |
| 6,101,266 | A | | 8/2000 | Laskowski et al. | |
| 6,237,739 | B1 | | 5/2001 | Mazur et al. | |
| 6,272,440 | B1 | * | 8/2001 | Shakespeare et al. | 702/85 |

* cited by examiner

*Primary Examiner*—Donald P. Walsh
*Assistant Examiner*—Mark J. Beauchaine
(74) *Attorney, Agent, or Firm*—Colin P. Cahoon; Carstens, Yee & Cahoon, LLP

(57) ABSTRACT

A document processing machine for identifying and authenticating documents having both transparent and opaque regions and routing the documents appropriately is provided. In one embodiment, the document processing machine includes an image capturing device, a light source, a data processing system, and a document control system. The image capturing device captures the image of at least a portion of a document wherein the document comprises transparent and non-transparent regions. The light source emits light toward the image capturing device and is positioned such that the document passes between the light source and the image capturing device. The data processing system is functionally connected to the image capturing device, and obtains the image of the document from the image capturing device, compares the image to a nominal pattern to determine whether the document is authentic, and determines the manner in which the document should be processed based upon whether the document is authentic. The document control system is functionally connected to the data processing system, and receives signals from the data processing system regarding the processing and routing of the document and executes instructions contained in the signals in order to route the document to a proper output bin.

22 Claims, 3 Drawing Sheets

VIGNETTE INSPECTION SYSTEM

BACKGROUND OF THE INVENTION

1. Technical Field

The present invention relates to document processing systems and, more particularly, to authenticating documents having both transparent and opaque regions.

2. Description of Related Art

High-speed currency processing machines are used by a variety of financial institutions to count, sort, and verify the authenticity of currency notes. For example, central banks use high-speed currency processing machines to verify deposits received from member banks. Deposits from a vault are delivered to a currency verification processing rooms, where the currency is fed into the high-speed processing machines. The machines count each note—at an average rate of 70,000 notes per hour—and confirm its denomination, fitness, and authenticity, and then automatically bundle fit notes into packages. The fit notes eventually make their way back into circulation when banks order currency from the central bank Incorrect denominations, suspected counterfeits, and non-machine-readable notes are rejected, and, if necessary, the depositing bank's account is debited or credited. If necessary, a user may inspect suspected counterfeit notes by hand, paying particular attention to the portrait, scroll work, seals, and colored fibers of each bill, as well as to the weight, color, and texture of the paper. In the United States Federal Reserve System, suspected counterfeits are stamped "COUNTERFEIT" and forwarded to the U.S. Secret Service, the Treasury agency charged with maintaining the integrity of the nation's currency.

To prevent and thwart counterfeiting of currency, a variety of techniques have evolved, such as, for example, the use of serial numbers, special paper, special inks, imbedded threads, and water marks to inhibit counterfeiters ability to copy authentic notes. For example, for each currency produced, a corresponding paper is manufactured. Banknote paper is typically made from cotton pulp which gives it better durability than commercial papers and a very distinctive feel. Much of the time, it is the initial feel of a counterfeit that urges someone to have a closer look at what they are holding. If bank note paper is held under ultra violet light it is dull compared to commercial papers. Furthermore, and more importantly for currency processing machines, the paper manufacturing process allows for a number of features to be created that may be detected by a currency processing machine.

The watermark is one of the most obvious security features of a paper banknote. When held up to the light an image can be seen in the paper, usually a portrait similar to that printed on the note. The image of the watermark is caused by different thicknesses of paper, with light areas of the watermark being a result of thinner paper. The highlighted effect of "ultra thin" paper is sometimes used as an added security effect in small specific areas within a watermark, e.g. a denomination may appear as a "highlighted" portion compared to the main bulk of the watermark. A watermark is an excellent security feature because a counterfeiter is very unlikely to manufacture his own paper.

Currency processing machines have evolved along with the currency to identify the features of a note that identify it as a valid note. For example, optical character recognition ("OCR") technology has been adapted for use in the currency processing field for lifting the serial code or code from processed notes. OCR technology is used, for example, for identifying specific notes processed by a high speed currency processing machine, such as those machines manufactured and marketed by Currency Systems International of Irving, Tex., by lifting a note's serial code using a camera device and then recording the serial code to the note processed. Other techniques have been developed to identify and verify watermarks.

However, paper currency has a serious flaw in that the average lifespan of paper currency is typically a few years at most. To overcome this deficiency, many countries have recently resorted to having currency printed on plastic notes rather than paper notes. Plastic notes, although more expensive to produce than paper notes, have the benefit of lasting up to ten times as long in circulation as a paper note does. This increased durability results in fewer printings thus providing savings in the number of notes issued that appears to more than offset the increased cost of using plastic notes rather than paper notes.

One other drawback of plastic notes is the inability to use watermarks as a security feature. to overcome this drawback, manufacturers of plastic currency notes have incorporated a transparent window or vignette within the currency note. An example of a currency note of this type is depicted in FIG. 1. Consequently, a need exists for a currency processing machine, system, and method for using this security feature in order to authenticate the currency note.

SUMMARY OF INVENTION

The present invention provides a document processing machine for identifying and authenticating documents having both transparent and opaque regions and routing the documents appropriately. In many typical embodiments, the documents processed are plastic currency notes having a vignette window containing an opaque pattern on a transparent background. In one embodiment, the document processing machine includes an image capturing device, a light source, a data processing system, and a document control system. The image capturing device captures the image of at least a portion of a document wherein the document comprises transparent and non-transparent regions. The light source emits light toward the image capturing device and is positioned such that the document passes between the light source and the image capturing device. The data processing system is functionally connected to the image capturing device, and obtains the image of the document from the image capturing device, compares the image to a nominal pattern to determine whether the document is authentic, and determines the manner in which the document should be processed based upon whether the document is authentic. The document control system is functionally connected to the data processing system, and receives signals from the data processing system regarding the processing and routing of the document and executes instructions contained in the signals in order to route the document to a proper output bin.

BRIEF DESCRIPTION OF THE DRAWINGS

The novel features believed characteristic of the invention are set forth in the appended claims. The invention itself, however, as well as preferred mode of use, further objectives and advantages thereof, will be best understood by reference to the following detailed description of illustrative embodiments when read in conjunction with the accompanying drawings, wherein:

DETAILED DESCRIPTION

Figure 1:
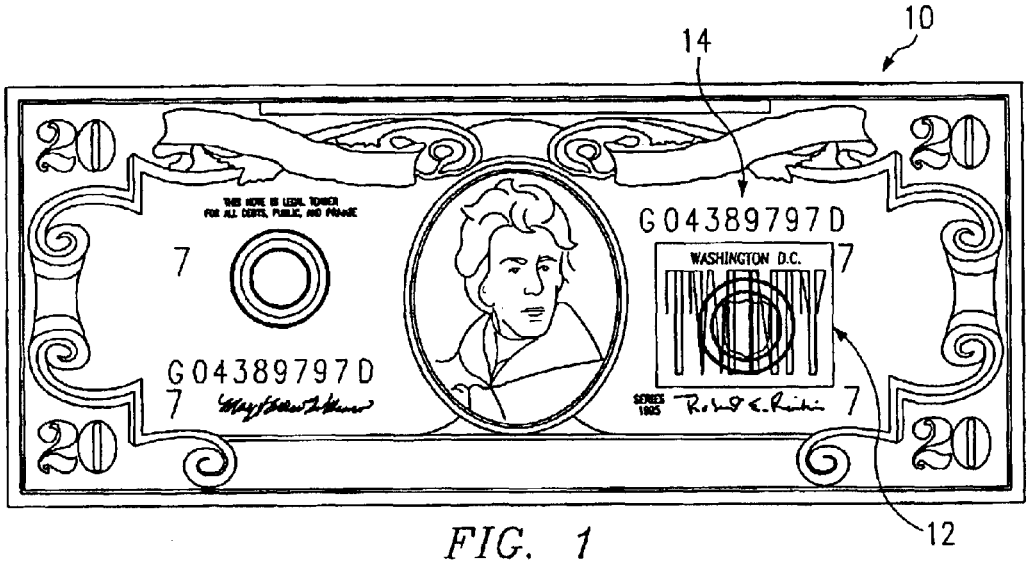
FIG. 1 illustrates an exemplary plastic currency note.

FIG. 1 illustrates an exemplary plastic currency note 10. FIG. 1 shows a serial codes 14 located in the upper right hand corner of the note 10. This code 14 can consist of combinations of numbers and/or letters. Also depicted in FIG. 1 is a vignette window 12. Vignette window 12 is transparent except for areas of patterning which help authenticate the note 10 and inhibit counterfeiting. Vignette window provides a substitute method of authenticating a note 10 when watermarking is not available. Alternative embodiments of note 10 may be constructed from paper with a plastic or other transparent media vignette window 12 constructed in a hollowed out portion of the paper note.

Figure 2:
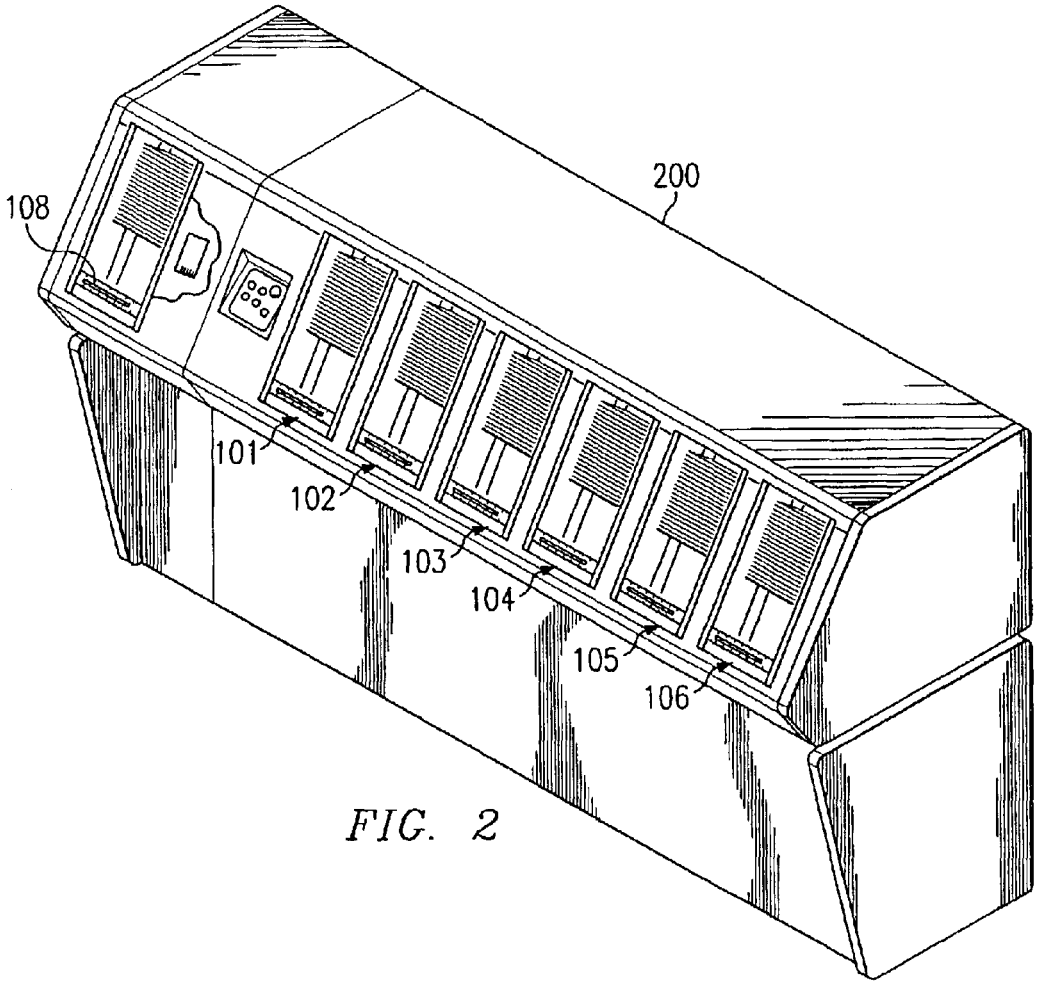
FIG. 2 depicts a high-speed currency processing machine is depicted in accordance with the present invention.

With reference now to FIG. 2, a high-speed currency processing machine is depicted in accordance with the present invention. Currency processing machine 200 is used to count and authenticate notes. Stacks of notes are inserted into input cassette 108 from which notes are removed one by one and input into the currency processing machine 200. The currency processing machine determines the denomination of the note as well as authenticates the note. Fit, authenticated, and counted notes are returned to the appropriate discharge slot cassette 101–106, for example, the discharge slot holding cassette 101. Unfit or counterfeit notes are returned to an appropriate discharge slot cassette 101–106 marked for unfit notes. The cassettes 101–106 are sealed and shipped appropriately.

Currency processing machine 200 also includes a data processing system and data input device 110. The data processing system receives signals from various monitoring devices within the currency processing machine 200 as well as provide instructions to various other devices within the currency processing machine that provide for routing the notes to the appropriate discharge slot cassettes 101–106 as well as accounting for the number and denomination of fit, unfit, and counterfeit notes.

The data input device 110 may be integral to the currency processing system 200 as depicted in FIG. 2, or it may be incorporated in a separate PC that is wired to electrical components within the currency processing machine. A data processing system, whether incorporated within the currency processing machine or embodied as a PC or other external computer coupled to the currency processing machine, implements software instructions which receive input from various data gathering devices within the currency processing machine. The input received from the currency processing machine allow the data processing system to determine the denomination and fitness of a note as well as whether the note is authentic or counterfeit. The data processing system then sends control instructions to various components within the currency processing machine to ensure that the note is routed to the proper output bin 101–106.

Figure 3:
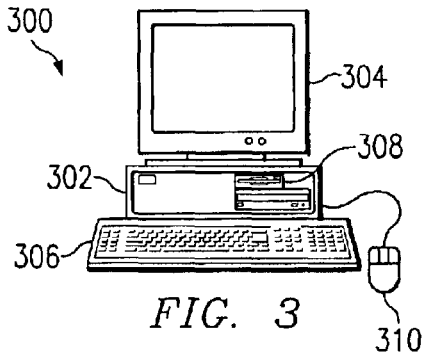
FIG. 3 depicts a pictorial representation of a data processing system in which the present invention may be implemented in accordance with one embodiment of the present invention.

Referring now to FIG. 3, a pictorial representation of a data processing system in which the present invention may be implemented is depicted in accordance with one embodiment of the present invention. A computer 300 is depicted which includes system unit 302, video display terminal 304, keyboard 306, storage devices 308, which may include floppy drives and other types of permanent and removable storage media, and mouse 310. Additional input devices may be included with personal computer 300, such as, for example, a joystick, touchpad, touch screen, trackball, microphone, and the like. Computer 300 can be implemented using any suitable computer, such as an IBM eServer computer or IntelliStation computer, which are products of International Business Machines Corporation, located in Armonk, N.Y. Although the depicted representation shows a computer, other embodiments of the present invention may be implemented in other types of data processing systems, such as a network computer. Computer 300 also preferably includes a graphical user interface (GUI) that may be implemented by means of systems software residing in computer readable media in operation within computer 300.

Figure 4:
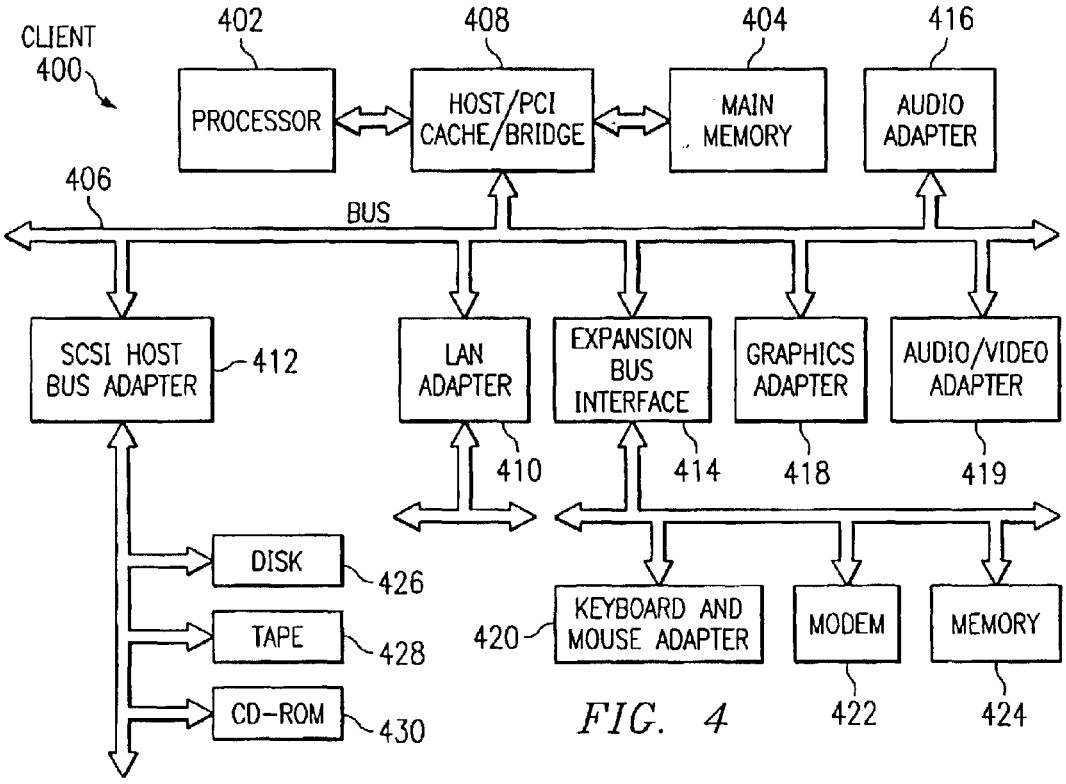
FIG. 4 depicts a block diagram of a general purpose data processing system in which the present invention may be implemented.

With reference now to FIG. 4, a block diagram of a general purpose data processing system is shown in which the present invention may be implemented. Data processing system 400 is an example of a computer, such as computer 300 in FIG. 3, in which code or instructions implementing the processes of the present invention may be located. Data processing system 400 employs a peripheral component interconnect (PCI) local bus architecture. Although the depicted example employs a PCI bus, other bus architectures such as Accelerated Graphics Port (AGP) and Industry Standard Architecture (ISA) may be used. Processor 402 and main memory 404 are connected to PCI local bus 406 through PCI bridge 408. PCI bridge 408 also may include an integrated memory controller and cache memory for processor 402. Additional connections to PCI local bus 406 may be made through direct component interconnection or through add-in boards. In the depicted example, local area network (LAN) adapter 410, small computer system interface SCSI host bus adapter 412, and expansion bus interface 414 are connected to PCI local bus 406 by direct component connection. In contrast, audio adapter 416, graphics adapter 418, and audio/video adapter 419 are connected to PCI local bus 406 by add-in boards inserted into expansion slots. Expansion bus interface 414 provides a connection for a keyboard and mouse adapter 420, modem 422, and additional memory 424. SCSI host bus adapter 412 provides a connection for hard disk drive 426, tape drive 428, and CD-ROM drive 430. Typical PCI local bus implementations will support three or four PCI expansion slots or add-in connectors.

An operating system runs on processor 402 and is used to coordinate and provide control of various components within data processing system 400 in FIG. 4. The operating system may be a commercially available operating system such as Windows XP or Windows 2000, which are available from Microsoft Corporation of Redmond, Wash. An object oriented programming system such as Java may run in conjunction with the operating system and provides calls to the operating system from Java programs or applications executing on data processing system 400. "Java" is a trademark of Sun Microsystems, Inc of Santa Clara, Calif.

Instructions for the operating system, the object-oriented programming system, and applications or programs are located on storage devices, such as hard disk drive 426, and may be loaded into main memory 404 for execution by processor 402.

Those of ordinary skill in the art will appreciate that the hardware in FIG. 4 may vary depending on the implementation. Other internal hardware or peripheral devices, such as flash read-only memory (ROM), equivalent nonvolatile memory, or optical disk drives and the like, may be used in addition to or in place of the hardware depicted in FIG. 4. Also, the processes of the present invention may be applied to a multiprocessor data processing system.

The depicted example in FIG. 4 and above-described examples are not meant to imply architectural limitations. For example, data processing system 400 may be implemented as a notebook computer, hand held computer, a kiosk, or a Web appliance. Typically data processing system 400 is not implemented in such embodiments as in the preceding list due to the fact that such embodiments typically lack the necessary processing power to process instructions sufficiently quickly to maintain high speed operation of the currency processing machine. However, nothing inherently prohibits such use and as processing power of computers continues to increase, it is possible that future versions of currency processing machines may make use of such embodiments as necessary or desired.

The processes of the present invention are performed by processor 402 using computer implemented instructions, which may be located in a memory such as, for example, main memory 404, memory 424, or in one or more peripheral devices 426–430.

Figure 5:
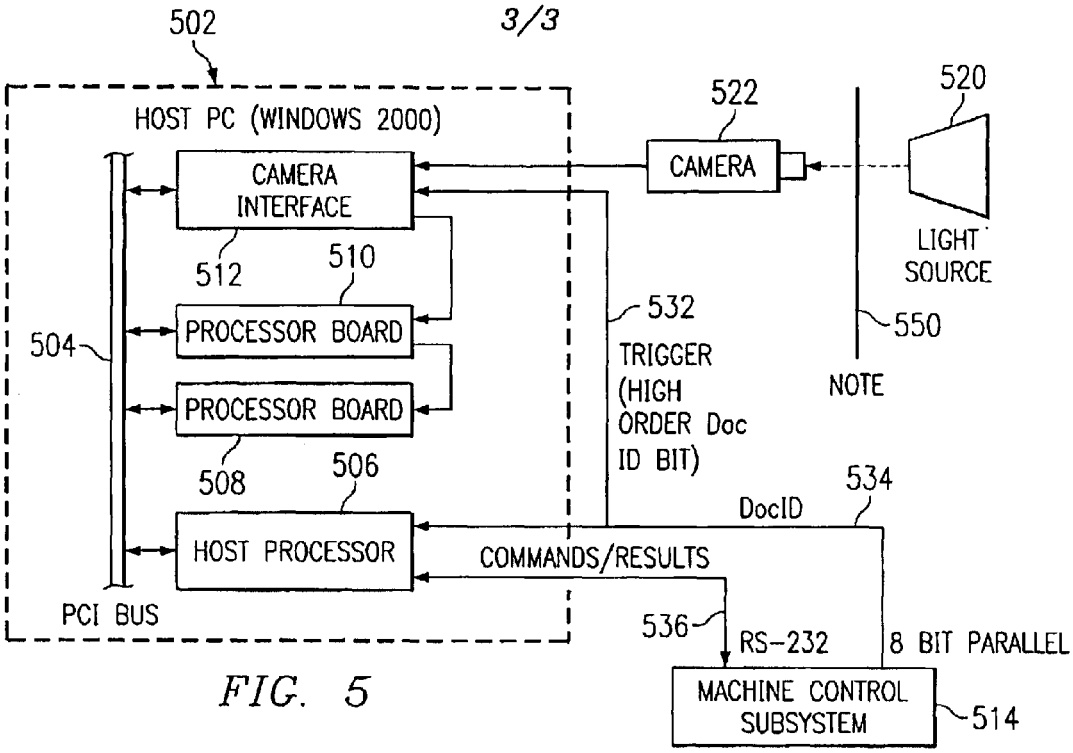
FIG. 5 depicts a schematic diagram illustrating an exemplary hardware configuration for a vignette inspection system in accordance with the present invention.

Turning now to FIG. 5, a schematic diagram illustrating an exemplary hardware configuration for a vignette inspection system is depicted in accordance with the present invention. In this embodiment, a host PC 502, which may be implemented as data processing system 400, is coupled to a camera 522 through camera interface 512. In this example, only the components of Host PC 502 that are needed to understand the processes of the present invention are depicted. Therefore, many components depicted in FIG. 3 are omitted for ease of explanation and understanding. As depicted in FIG. 3, the various components 504, 506, 508, 510, and 512 of host PC 502 are coupled to one another via a PCI bus 504. The camera 522 is positioned opposite a light source 520 such that as a note 550 is passed through the currency processing machine 200, it passes between the light source 520 and the camera 522. As the note 550 passes the camera 522, the camera 522 captures images of the vignette window of note 550. Light from light source 520 passes through the note 550 in transparent areas of the vignette window and is blocked by opaque areas of the note 550 and vignette window. Thus, the image captured by camera 522 represents areas of light and dark matching the pattern on the vignette window.

The digitized image is transmitted from the camera 522 to the camera interface 512 of host PC 502. Processor boards 508 and 510 are optional additional processors that provide additional processing power if desired by the user. If needed, the captured images can be made available to processor boards 508 and 510 as well as to host processor 506. The captured image received by camera interface 512 is compared, by the host processor 506, to a nominal pattern to determine whether the note is authentic. Defects in the captured image represent non-transparent regions that are not part of the nominal pattern or transparent regions where the nominal pattern is not transparent. Notes whose captured image vary from the nominal pattern by less than a specified error limit are passed as authentic notes. All other notes are identified as being counterfeit or otherwise non-authentic.

Once the host PC 502 determines whether the note 550 is authentic, a commands/results signal 536 is sent to the machine control subsystem 514 instructing the machine control subsystem 514 as to how to route the note 550 so that the note 550 is placed in the proper output discharge slot cassette 101–106. The DocID 534 and the Trigger 532 signals are provided to the host PC 502 by the machine control system 514. The trigger signal 532 initiates the acquisition of each image and is asserted when a document 550 leading edge is about to reach the camera 522. The Doc ID 534 is a numeric value and is asserted at the same time as the trigger signal 532. The Doc ID 534 is used as an identifier for the document 550. When the processed results from the host PC 502 are returned to the machine control system 514, the Doc ID 534 is included so the control system can associate a given result message with a specific document 550.

A buffer spacing distance between the camera 522 and light source 520 location of the currency processing machine 200 and the location of the devices (not shown) for routing the note 550 is required in order to allow the host PC 502 sufficient time to determine the identity and authenticity of the note 550 and instruct the machine control susbsystem 514 accordingly. The devices for routing the note 550 are located downstream in the direction of note movement through the currency processing machine from the location of the camera 522 and light source 520. This buffer spacing distance varies from embodiment to embodiment depending on such factors as the speed at which the notes are run through the currency processing machine 200 and the speed at which the host PC 502 and related electronics can process the information as to the identity and authenticity of the note 550.

Figure 6:
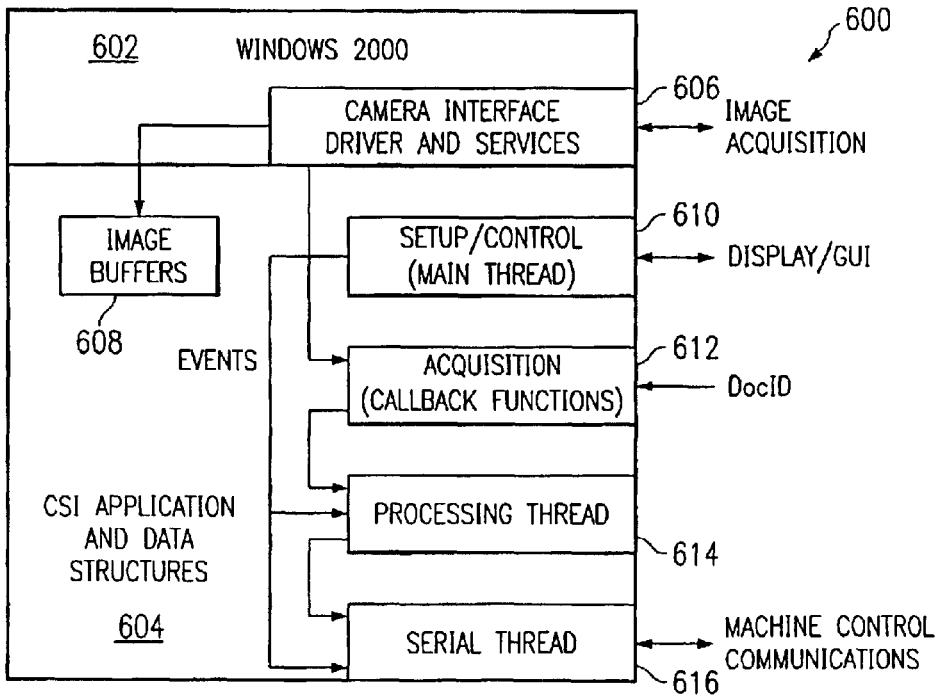
FIG. 6 depicts a schematic diagram of a software configuration for an exemplary vignette inspection system in accordance with the present invention.

Turning now to FIG. 6, a schematic diagram of a software configuration for an exemplary vignette inspection system is depicted in accordance with the present invention. Software system 600 includes an operating system 602, such as, for example, Windows 2000, running on a data processing system such as, for example, data processing system 400 in FIG. 4. The vignette inspection system software 604 runs on top of the operating system 602 includes kernel mode driver and services 606 for interfacing with the image acquisition system. Images received from the image acquisition system are stored for a limited time in an image buffer 608. A user may recall an image from the image buffer for display if desired in order to check the accuracy of the system or to make a determination of authenticity of a note when the system is unable to determine whether a note is authentic. Each note passed through the currency processing system is assigned a document ID which is also associated with the captured image of the note.

In order to maximize efficiency, several threads 610, 612, 614, and 616 are maintained when the vignette inspection system software 604 is operating. The setup control thread 610 allows for a user to interact with the software 604. The acquisition thread 612 controls the capture of each image and its transfer to a memory buffer 608 for processing. Once an image has been captured, the acquisition thread 612 signals the processing thread 614 to process the image. The processing thread 614 then locates and inspects the vignette feature, generates a result message and signals the serial thread 616 to transmit the message to the machine control subsystem 514. An important point in this embodiment is that the Vignette Inspection System (i.e., host PC 502) does not make any decision about where or how to sort a given note, it simply reports what it found out about the note. The sorting decision is made by processing logic within the machine control subsystem 514.

It is important to note that while the present invention has been described in the context of a fully functioning data processing system, those of ordinary skill in the art will appreciate that the processes of the present invention are capable of being distributed in the form of a computer readable medium of instructions and a variety of forms and that the present invention applies equally regardless of the particular type of signal bearing media actually used to carry out the distribution. Examples of computer readable media include recordable-type media such a floppy disc, a hard disk drive, a RAM, and CD-ROMs and transmission-type media such as digital and analog communications links.

The description of the present invention has been presented for purposes of illustration and description, but is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A document processing machine, comprising:

an image capturing device for capturing the image of at least a portion of a document wherein the document includes a transparent vignette window that contains non-transparent regions forming a pattern;

a light source emitting light toward the image capturing device, wherein the light source is positioned such that the document passes between the light source and the image capturing device;

a data processing system functionally connected to the image capturing device, wherein the data processing system obtains the image of the document vignette window from the image capturing device, compares the image to a nominal pattern to determine whether the document is authentic, and determines the manner in which the document should be processed based upon whether the document is authentic; and a document control system functionally connected to the data processing system, wherein the document control system receives signals from the data processing system regarding the processing of the document and executes instructions contained in the signals in order to route the document to a proper output bin.

2. The document processing machine as recited in claim 1, wherein the document is a currency note.

3. The document processing machine as recited in claim 2, wherein the currency note is constructed from paper and the vignette window is constructed from plastic and placed in a hollowed out portion of the paper note.

4. The document processing machine as recited in claim 2, wherein the currency note is constructed from plastic.

5. The document processing machine as recited in claim 1, wherein the image capturing device is a camera.

6. The document processing machine as recited in claim 5, wherein the camera is a line scan camera.

7. The document processing machine as recited in claim 1, wherein the document control system comprises mechanical devices for engaging and routing the document, wherein the mechanical devices are located downstream in the direction of document movement at a distance sufficient to provide time for the data processing system to determine the manner in which the document should be routed.

8. The document processing machine as recited in claim 7, wherein the distance sufficient to provide time for the data processing system is determined based on the speed of documents processed through the document processing machine and the processing speed of the data processing system.

9. A document processing system, comprising:

image capturing means for capturing the image of at least a portion of a document wherein the document includes a transparent vignette window that contains non-transparent regions forming a pattern;

light means for emitting light toward the image capturing means, wherein the light means is positioned such that the document passes between the light means and the image capturing means;

data processing means functionally connected to the image capturing means, wherein the data processing means obtains the image of the document vignette window from the image capturing means, compares the image to a nominal pattern to determine whether the document is authentic, and determines the manner in which the document should be processed based upon whether the document is authentic; and document control means functionally connected to the data processing means, wherein the document control means receives signals from the data processing means regarding the processing of the document and executes instructions contained in the signals in order to route the document to a proper output bin.

10. The document processing system as recited in claim 9, wherein the document is a currency note.

11. The document processing system as recited in claim 10, wherein the currency note is constructed from paper and the vignette window is constructed from plastic and placed in a hollowed out portion of the paper note.

12. The document processing system as recited in claim 10, wherein the currency note is constructed from plastic.

13. The document processing system as recited in claim 9, wherein the image capturing means comprise a camera.

14. The document processing system as recited in claim 13 wherein the camera is a line scan camera.

15. The document processing system as recited in claim 9, wherein the document control means comprises mechanical means for engaging and routing the document, wherein the mechanical means are located downstream in the direction of document movement at a distance sufficient to provide time for the data processing means to determine the manner in which the document should be routed.

16. The document processing system as recited in claim 15, wherein the distance sufficient to provide time for the data processing system is determined based on the speed of documents processed through the document processing machine and the processing speed of the data processing system.

17. A method for determining the authenticity of a document with a vignette window containing opaque and transparent regions and routing the document accordingly, the method comprising:

receiving an image of the document vignette window wherein the image indicates pattern formed by the opaque and transparent regions;

comparing the image to a nominal pattern;

responsive to a determination that the document is authentic based upon the comparing step, routing the document to a first output area; and responsive to a determination that the document is not authentic, routing the document to a second output area.

18. The method as recited in claim 17, wherein the image is determined by orienting a camera to view a light source as the document passes between the light source and the camera, thereby determining the transparent and opaque regions of the document.

19. The method as recited in claim 17, wherein the document is a currency note.

20. A computer program product in a computer readable medium for use in a data processing system for determining the authenticity of a document with a vignette window containing opaque and transparent regions and routing the document accordingly, the computer program product comprising:

first instructions for receiving an image of the document vignette window wherein the image indicates a pattern formed by the opaque and transparent regions;

second instructions for comparing the image to a nominal pattern;

third instructions, responsive to a determination that the document is authentic based upon the comparing step, for routing the document to a first output area; and fourth instructions, responsive to a determination that the document is not authentic, for routing the document to a second output area.

21. The computer program product as recited in claim 20, wherein the image is determined by orienting a camera to view a light source as the document passes between the light source and the camera, thereby determining the transparent and opaque regions of the document.

22. The computer program product as recited in claim 20, wherein the document is a currency note.

* * * * *

UNITED STATES PATENT AND TRADEMARK OFFICE

CERTIFICATE OF CORRECTION

PATENT NO. : 6,811,016 B2
DATED : November 2, 2004
INVENTOR(S) : Ronald Bruce Blair It is certified that error appears in the above-identified patent and that said Letters Patent is hereby corrected as shown below:

Column 8,
Line 60, claim 17 should read:
17. A method for determining the authenticity of a document with a vignette window containing opaque and transparent regions and routing the document accordingly, the method comprising:

receiving an image of the document vignette window wherein the image indicates a pattern formed by the opaque and transparent regions;
comparing the image to a nominal pattern;
responsive to a determination that the document is authentic based upon the comparing step, routing the document to a first output area; and
responsive to a determination that the document is not authentic, routing the document to a second output area.

Signed and Sealed this

Twenty-ninth Day of November, 2005

JON W. DUDAS
*Director of the United States Patent and Trademark Office*